US009664057B2

(12) United States Patent
Feldmann et al.

(10) Patent No.: US 9,664,057 B2
(45) Date of Patent: May 30, 2017

(54) STATOR VANE SEGMENT OF A FLUID FLOW MACHINE AND TURBINE

(71) Applicant: MTU Aero Engines AG, Munich (DE)

(72) Inventors: Manfred Feldmann, Eichenau (DE); Norbert Schinko, Munich (DE); Janine Sangl, Dachau (DE); Alexander Buck, Munich (DE)

(73) Assignee: MTU Aero Engines AG, Munich (DE)

( * ) Notice: Subject to any disclaimer, the term of this patent is extended or adjusted under 35 U.S.C. 154(b) by 400 days.

(21) Appl. No.: 14/295,970

(22) Filed: Jun. 4, 2014

(65) Prior Publication Data

US 2014/0363284 A1 Dec. 11, 2014

(30) Foreign Application Priority Data

Jun. 6, 2013 (EP) ..... 13170852

(51) Int. Cl.
*F01D 11/00* (2006.01)
*F01D 25/24* (2006.01)
*F01D 9/04* (2006.01)

(52) U.S. Cl.
CPC ..... *F01D 11/005* (2013.01); *F01D 9/04* (2013.01); *F01D 25/246* (2013.01); *F05B 2240/11* (2013.01); *F05B 2240/57* (2013.01)

(58) Field of Classification Search
CPC ..... F01D 11/005; F01D 25/246; F01D 9/04; F05B 2240/11; F05B 2240/57
See application file for complete search history.

(56) References Cited

U.S. PATENT DOCUMENTS 5,154,577 A 10/1992 Kellock et al.
6,241,467 B1 * 6/2001 Zelesky ..... F01D 5/187 415/115
6,254,333 B1 7/2001 Merry
8,210,797 B2 * 7/2012 Dueckershoff ..... F01D 9/041 415/115
8,376,705 B1 * 2/2013 Liang ..... F01D 9/04 415/115
2010/0150710 A1 * 6/2010 Khanin ..... F01D 9/041 415/208.1
2010/0284800 A1 11/2010 Sewall et al.
2011/0217155 A1 * 9/2011 Meenakshisundaram ..... F01D 11/005 415/1

(Continued)

FOREIGN PATENT DOCUMENTS

EP 1074695 2/2001

*Primary Examiner* — John K Fristoe, Jr.
*Assistant Examiner* — Behnoush Haghighian
(74) *Attorney, Agent, or Firm* — Davidson, Davidson & Kappel, LLC

(57) ABSTRACT

A stator vane segment (100) of a fluid flow machine, having an upstream casing-side attachment (1) and/or a downstream casing-side attachment (3), and a platform (5). The attachments are provided on the platform (5). The platform (5) has a first sealing section (17) and extends in the direction of flow beyond a connection region (15) that connects the rearward attachment (3) to the platform (5). The first sealing section (17) that is located in a section (18) downstream of the connection region (15) has a first slot (19) which is continuous in the circumferential direction. The present invention also relates to a turbine having at least one stator vane segment (100).

12 Claims, 5 Drawing Sheets

(56) References Cited

U.S. PATENT DOCUMENTS

| | | | | |
|---|---|---|---|---|
| 2012/0128472 | A1* | 5/2012 | Singh | F01D 25/246 415/178 |
| 2013/0315708 | A1* | 11/2013 | Rendon | F01D 11/005 415/110 |
| 2015/0125289 | A1* | 5/2015 | Maltaverne | F01D 5/147 415/209.2 |

* cited by examiner

STATOR VANE SEGMENT OF A FLUID FLOW MACHINE AND TURBINE

This claims the benefit of European Patent Application No. EP 13170852.1, filed Jun. 6, 2013 and hereby incorporated by reference herein.

The present invention relates to a stator vane segment of a fluid flow machine, having an upstream and/or a downstream attachment means on the casing side, and a platform.

The present invention also relates to a turbine, in particular a gas turbine.

BACKGROUND

In fluid flow machines, stator vanes may be mounted to the casing in different ways. Typically, attachment is by an upstream and a downstream means for attachment to the casing, which means are connected by a stator vane platform from which the stator vane extends. Depending on the design of the means for attachment to the casing and of the stator vane platforms, sealing elements may be integrated in individual stator vane segments in order to seal joints or gaps existing between adjacent stator vane segments. The purpose of this is to seal off the flow channel from the casing cavities.

SUMMARY OF THE INVENTION

It is an object of the present invention to provide another stator vane segment of a fluid flow machine, which has at least one first sealing section. Another object of the present invention is to provide a turbine having at least one stator vane segment.

The present invention provides a stator vane segment of a fluid flow machine, which has an upstream, or forward, and a downstream, or rearward, attachment means on the casing side, as well as a platform. Alternatively, the stator vane segment may have either an upstream or a downstream attachment means on the casing side, as well as a platform.

The attachment means are provided on the platform. For example, the upstream casing-side attachment means may be provided in the forward section of the platform, and the downstream casing-side attachment means may be provided in the rearward section of the platform.

The platform has a first sealing section.

Furthermore, the platform extends beyond a connection region that connects the rearward attachment means to the platform, as referred to the direction of flow during use of the stator vane segment.

In accordance with the present invention, the first sealing section that is located in a section downstream of the connection region has a first slot which is continuous in the circumferential direction.

In all of the above and following discussion, the expressions "may be" and "may have", etc., will be understood to be synonymous with "is preferably" and "preferably has", etc., and are intended to illustrate specific embodiments according to the present invention.

Whenever number words are mentioned herein, these will be understood by those skilled in the art as an indication of a lower numerical limit. Therefore, for example, when "one" is specified, those skilled in the art will always read this to imply "at least one", unless this would constitute a contradiction recognizable by those skilled in the art. This understanding is included in the present invention, as well as the interpretation that a number word such as "one" may alternatively be meant to mean "exactly one" whenever this is recognizable as technically possible by those skilled in the art. Both of these cases are covered by the present invention and apply to all number words used herein.

Advantageous refinements of the present invention are the subject matter of the respective dependent claims and specific embodiments.

Specific embodiments of the present invention may include one or more of the features mentioned below, in any combination.

In some embodiments of the present invention, the fluid flow machine is a compressor or a turbine, in particular a gas turbine.

In some embodiments of the present invention, the term "stator vane segment", as used herein, denotes an array or a segment having one or more stator vanes and/or optionally provided further sections (or elements, segments, portions) connected to the stator vane(s).

In several embodiments of the present invention, a stator vane segment is a stator vane cluster. A stator vane cluster may have a plurality of stator vanes, in particular three stator vanes, at least one, but typically two, attachment means on the casing side, and at least one platform. A stator vane may have at least one stator vane airfoil having a pressure side and a suction side, as well as a leading airfoil edge and a trailing airfoil edge.

The term "downstream casing-side attachment means", as used herein, refers to an attachment means that is located further downstream or rearward than an upstream, or forward, attachment means located further upstream. The direction of flow may be referred to as the axial direction of the longitudinal axis of the fluid flow machine. The radial direction is perpendicular to the axial direction. The circumferential direction lies in a plane perpendicular to the axial direction. The term "attachment means" s defined herein is a structure synonymous with "an attachment."

In several embodiments of the present invention, the first sealing section is a groove or a recess, hereinafter referred to as groove. A groove may be U-shaped in cross-section (perpendicular to the longitudinal direction). A groove may have a rectangular, polygonal, semicircular or other cross-sectional shape.

In some embodiments of the present invention, the groove may be prepared and/or designed and/or configured to receive a sealing element, such as a sealing plate, or may have a sealing element. The sealing plate may, for example, be inserted, introduced, or clamped into the groove or otherwise connected thereto. The sealing section may create a connection between adjacent stator vane segments. The sealing function of the sealing section may be completely or at least partially achieved after insertion of the sealing plate. The sealing function may serve to seal off the flow channel toward or from the cavities of the casing of the fluid flow machine in the region of the stator vanes.

The first sealing section, as well as additional sealing sections, may be referred to as sealing segments.

In certain embodiments according to the present invention, the sealing section is a means or device for receiving a sealing plate or an insertable sealing device.

In several embodiments of the present invention, the term "connection region that connects the rearward attachment means to the platform", as used herein, refers to the base, connection point, connection portion, or transition region between the downstream rearward casing-side attachment means and the platform.

The base may be manufactured together with the attachment means and the platform as one piece or section, in particular as a casting. The casting may be referred to as an integral casting that performs all the functions of the attachments means, the platform, and the connection region (or transition region).

In certain embodiments according to the present invention, the connection region has an increased concentration of material due, for example, to structurally required roundings and/or material reinforcements in the connection region.

In several embodiments of the present invention, the upstream attachment means has a second sealing section, and the downstream attachment means has a third sealing section.

In some embodiments of the present invention, the first and/or second and/or third sealing section is adapted for insertion of sealing plates or has sealing plates. Specifically, the three sealing sections (first, second and/or third sealing section) may have sealing plates and be arranged so as to seal off the casing cavities from the flow passage of the fluid flow machine.

In certain embodiments according to the present invention, the platform and the first sealing section extend beyond an airfoil trailing edge of the stator vane in the direction of flow downstream of the connection region. The stator vane segment may have one or more stator vanes. The extension of the platform and of the first sealing section may apply to one or more stator vanes. Even if the stator vane segment has a plurality of stator vanes, it is within the scope of the present invention that the extension may not apply to all of the stator vanes, but merely be provided for one or less than all of the stator vanes.

In some embodiments of the present invention, the first sealing section of the platform extends completely or partially beyond the connection region between the rearward attachment means and the platform. If the extension is only partial, the platform does in fact have a first sealing section, but this sealing section does not extend beyond the connection region of the rearward attachment means.

In several embodiments of the present invention, the section of the platform downstream of the connection region has a second slot. The second slot may be continuous, for example outwardly, in a radial direction. A radially outwardly continuous second slot is a slot which starts at the first slot and is connected thereto and which is continuous or open outwardly (i.e., opens into the cavities of the casing).

In some embodiments of the present invention, the section of the platform downstream of the connection region has a second slot which is only inwardly continuous in a radial direction. In this exemplary embodiment, a radially inwardly continuous second slot is a slot which is continuous from the first slot inwardly (and opens into the flow passage of the fluid flow machine).

In contrast, in certain embodiments, the section of the platform downstream of the connection region has a second slot which is radially continuous both outwardly and inwardly.

A second slot enables an advantageous reduction of the stiffness of the stator vane segment, especially in the connection region between the rearward attachment means and the platform.

The second slot may have a square, rectangular, trapezoidal, oval or other cross section in a plane perpendicular to its longitudinal axis.

In the circumferential direction, the longitudinal axis may be disposed straight (normal) or at an angle (diagonally) with respect to the circumferential direction and the direction of flow.

In some embodiments of the present invention, the section of the platform that is located downstream of the connection region has a third slot which is continuous in the circumferential direction. For example, the second slot is located at one end of the aforementioned section (as referred to the circumferential direction), while the third slot is located at the other end. Thus, further stator vane segments may be disposed at both ends of the section in the circumferential direction.

In several embodiments of the present invention, the section of the platform downstream of the connection region has a tapered wall thickness; i.e., a decreasing wall thickness, in a portion thereof. The wall thickness may taper in a radial direction and/or in the circumferential direction.

In certain embodiments of the present invention, the stator vane segment has at least two stator vanes. A stator vane segment having at least two stator vanes may be referred to as stator vane cluster. The stator vane cluster may, in particular, have three stator vanes.

In certain embodiments according to the present invention, the stator vane segment is manufactured as a casting, in particular as an integral casting, in particular in one piece. A casting having a plurality of functional portions or sections may be referred to as an integral casting. An integral stator vane segment may have one or more stator vanes, a forward and/or a rearward attachment means on the casing side, as well as a platform. A stator vane segment that is manufactured as a casting is finished (e.g., ground), in particular at the faces of abutment with other, adjacent stator vane segments. Moreover, sealing sections provided on a cast stator vane segment may be subjected to finishing operations.

In several embodiments of the present invention, the sealing sections are manufactured or finished by electrical discharge machining.

Some or all of the embodiments of the present invention may have one, several or all of the advantages mentioned above and/or hereinafter.

During manufacture of fluid flow machines, in particular gas turbines, in accordance with the prior art, points of connection or abutment of stator vane segments, in particular stator vane clusters, may be sealed using sealing plates. To this end, sealing sections, seal grooves or seal slots may be formed in the abutment faces in the hub region and the casing region of the gas turbines, and sealing plates may be inserted therein during assembly of fluid flow machine. In this way, the gas or flow channel may be sealed off toward the casing cavities in the region of the stator vanes. In the connection region between the rearward casing-side attachment means and the platform of the stator vane segment, there may be an increase of material as a result of structurally required reinforcements, for example by material deposition at abutting edges, which result in roundings. This may lead to an increase in stiffness in this region, which may have a negative effect on the endurable thermomechanical stress change cycles in the region of the airfoil trailing edge on the pressure side and may result in an unwanted, premature failure of the prior art component.

A reduction of the stiffness in the stator vane segment design may involve or be achieved by a reduction of the length of the sealing plate. This, however, may lead to a decrease or reduction in the gap-sealing effect, which may result in an increase in the losses caused by leakage. Thus, there is a conflict between sealing effectiveness on the one hand, and the endurable stress changes at the point considered on the other hand.

The first slot, which, in accordance with the present invention, is provided in the first sealing section of the stator vane segment of the present invention, enables an advantageous reduction of the stiffness of the stator vane segment, especially in the connection region between the rearward casing-side attachment means and the platform. A reduction of the stiffness, and thus, indirectly, an increase in the endured stress cycles during operation of the fluid flow machine, may advantageously be achieved by a stator vane segment according to the present invention (due to the integration of sealing sections as narrow ribs or webs at the point of abutment of the outer face of the rearward platform). Furthermore, the extension or continuation of the sealing plates or their rear edges beyond the trailing edges of the stator vanes may advantageously improve the sealing of the casing cavities in the region of the rearward platform (reducing the thermal input into the rearward means for attachment to the casing and/or providing the possibility of using less cooling air).

BRIEF DESCRIPTION OF THE DRAWINGS

The present invention will now be described, by way of example only, with reference to the accompanying drawings, in which identical or similar components are indicated by the same reference numerals. The figures are simplified schematic views in which.

DETAILED DESCRIPTION

Figure 1:
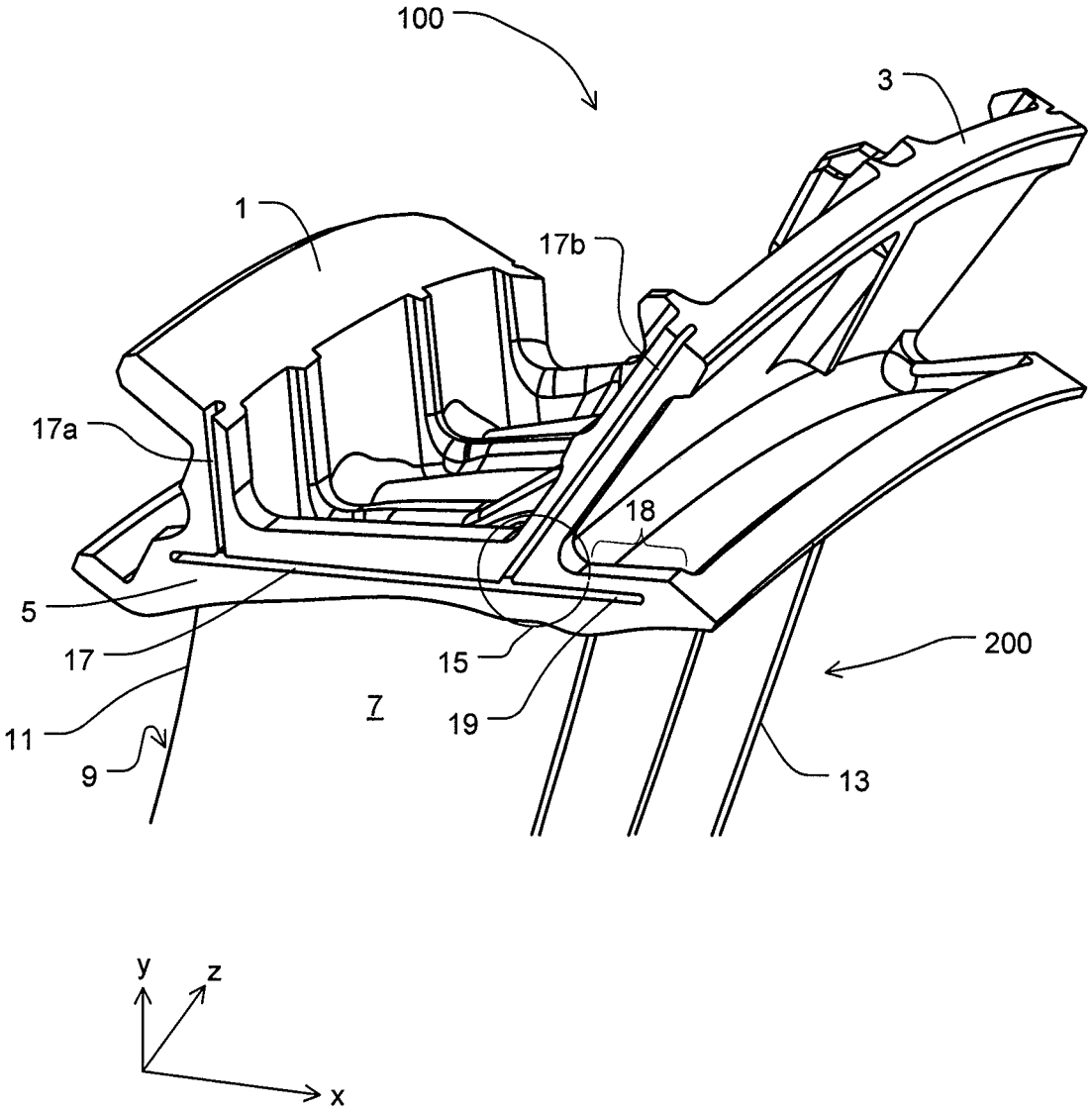
FIG. 1 is a perspective view of a portion of a stator vane segment according to the present invention.

FIG. 1 shows in perspective view a portion of a stator vane segment 100 according to the present invention.

The stator vane segment 100 according to the present invention has an upstream casing-side attachment means 1, a downstream casing-side attachment means 3, a platform 5, as well as three stator vanes 200.

Each stator vane 200 has a pressure side 7, a rear suction side 9 (concealed), a stator vane leading edge 11, as well as a stator vane trailing edge 13.

A connection region 15 connects rearward attachment means 3 to platform 5, which merge into one another in connection region 15.

FIG. 1 further shows a first sealing section 17, which extends into a section 18 downstream of connection region 15. In section 18, first sealing section 17 is configured or formed as a first slot 19. First slot 19 is continuous in circumferential direction z.

In addition to first sealing section 17 in platform 5, stator vane array or segment 100 has a second sealing section 17*a* in upstream attachment means 1, as well as a third sealing section 17*b* in downstream attachment means 3.

Sealing sections 17, 17*a*, 17*b* allow insertion of sealing plates therein. These sealing plates allow the points of connection or abutment to further sealing sections in adjacent stator vane segments (not shown in FIG. 1) to be bridged and thereby sealed. In addition to the function of sealing the flow passage between the stator vanes, these sealing plates may also perform a thermal sealing function, or thermal insulation, in the form of a heat shield. Thus, the sealing plates may perform an integral function with respect to the flow-related and temperature-related sealing function between the flow passage and the casing.

The sealing plate that is inserted into first sealing section 17 may extend into section 19 of platform 5. In the circumferential direction of first slot 19, this sealing plate may extend either only across a part of the total slot depth (e.g., corresponding to the depth of first sealing section 17 in the circumferential direction), across the total slot depth, or beyond the total slot depth. The stiffness of section 18 is affected accordingly. For example, for a smaller sealing plate depth in the circumferential direction, the stiffness is lower.

Figure 2:
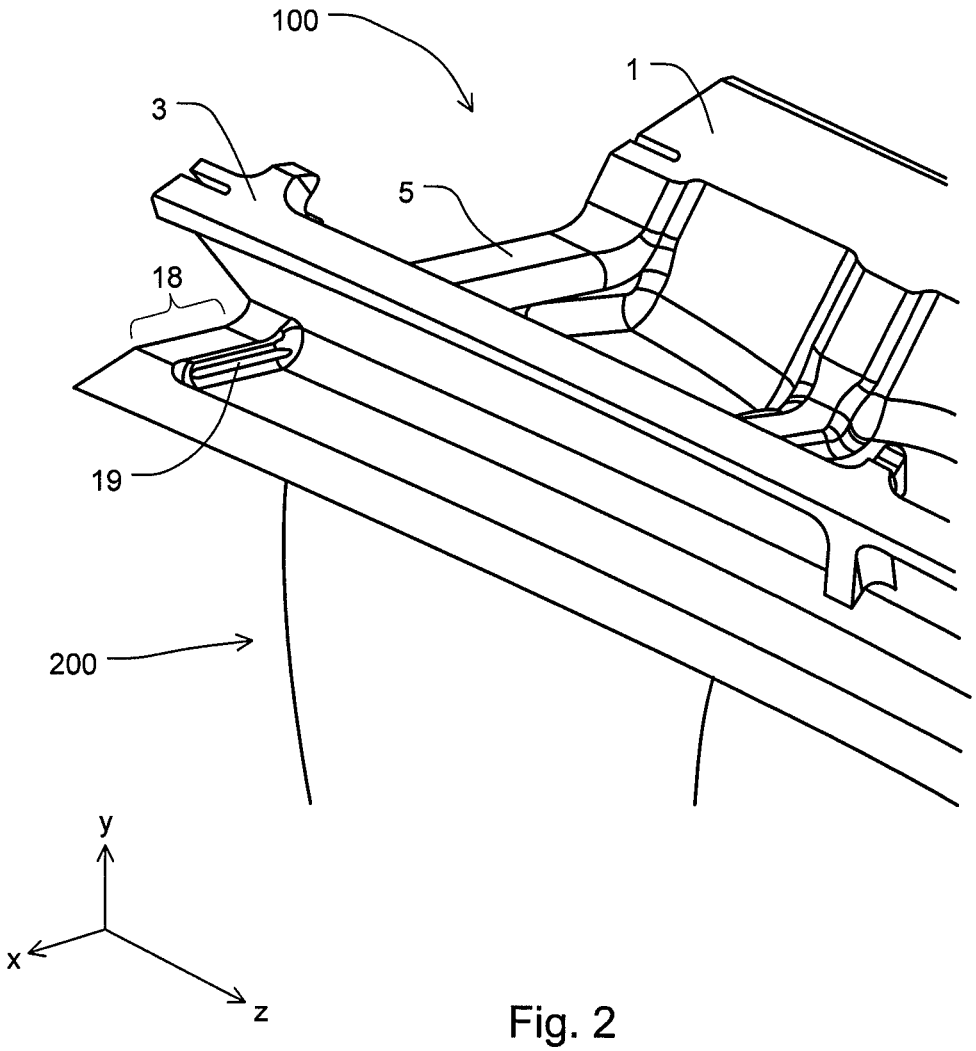
FIG. 2 is another perspective view of the stator vane segment according to the present invention shown in FIG. 1.

FIG. 2 shows the inventive stator vane segment 100 of FIG. 1 in another perspective view.

In section 18, first slot 19 is continuous in circumferential direction z.

Figure 3A:
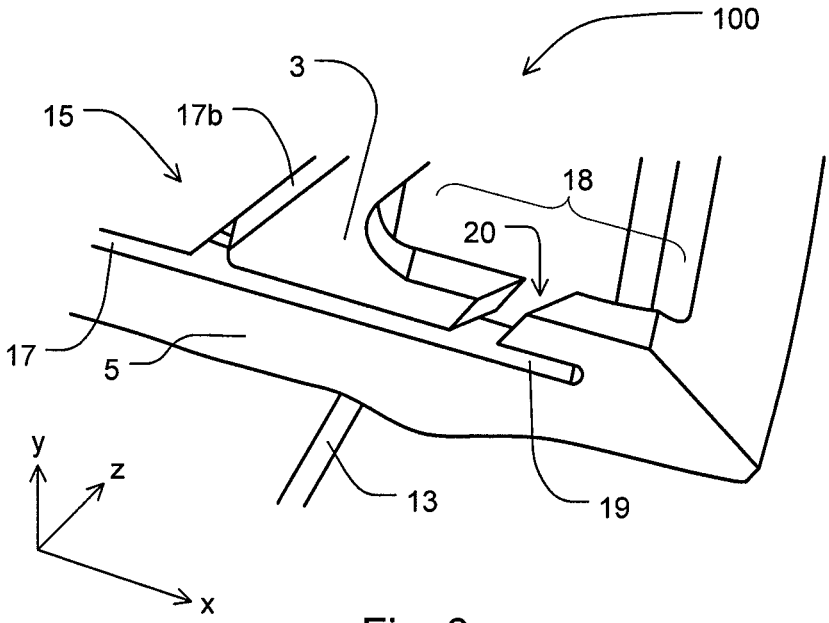
FIG. 3*a* is a detail of a perspective view of another stator vane segment according to the present invention having a first slot.

FIG. 3*a* shows a detail of a perspective view of another inventive stator vane segment 100 having a second slot 20 which is continuous and open in both radial direction y and circumferential direction z.

Figure 3B:
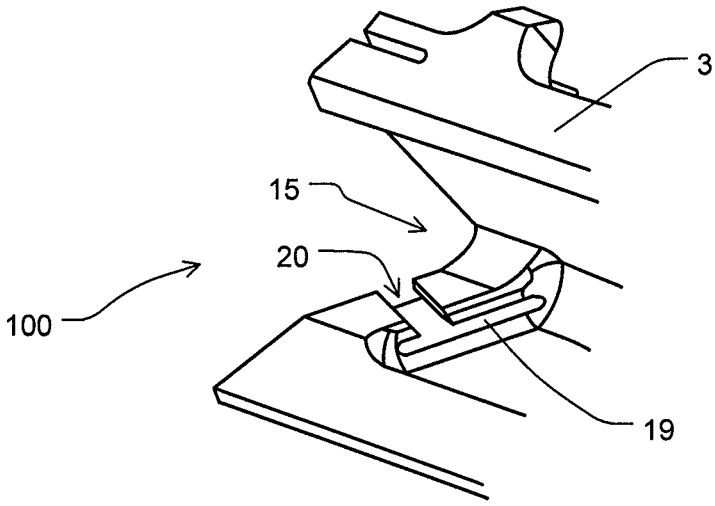
FIG. 3*b* is another perspective view of the stator vane segment according to the present invention shown in FIG. 3*a;*

FIG. 3*b* shows the further inventive stator vane segment 100 of FIG. 3*a* in another perspective view.

Figure 3C:
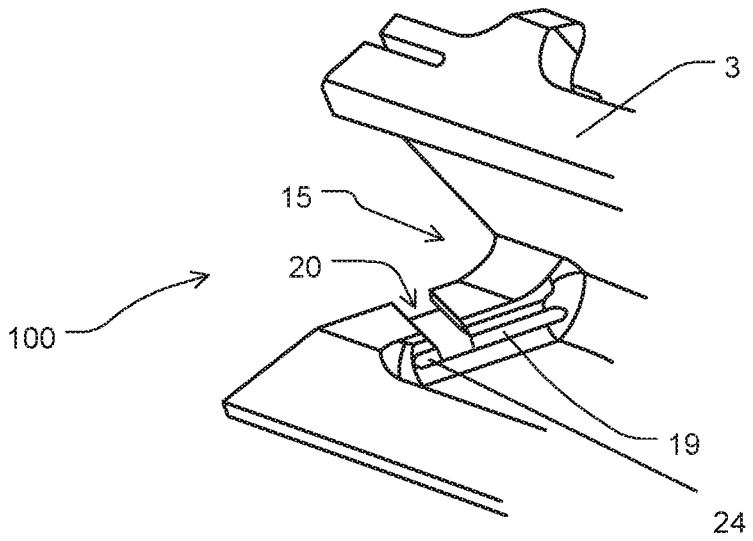
FIG. 3*c* is a perspective view of the stator vane segment according to another embodiment of the present invention.

FIG. 3*c* shows another embodiment of the present invention in which the stator vane includes a first slot 19, a second slot 20, and a third slot 24.

Figure 4A:
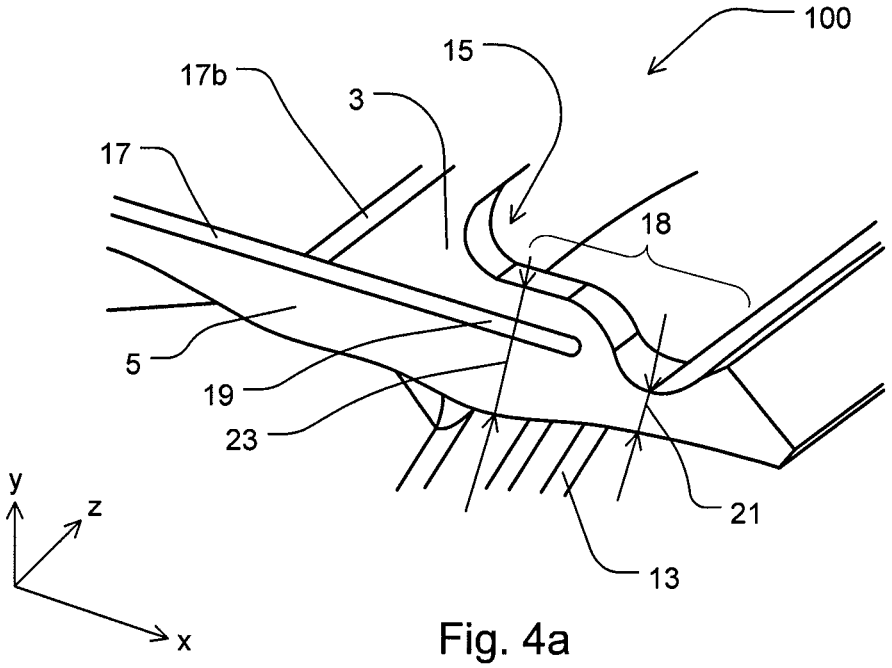
FIG. 4*a* is a detail of a perspective view of yet another stator vane segment according to the present invention.

FIG. 4*a* shows a detail of a perspective view of yet another stator vane segment 100 according to the present invention.

First slot 19 extends less far into section 18 in the direction of flow x as compared to its extension in FIG. 1 and FIG. 2. Due to this shortening, the wall thickness 21 in radial direction y is smaller than the wall thickness 23 with slot 19. This makes it possible to advantageously reduce the stiffness of section 18.

Figure 4B:
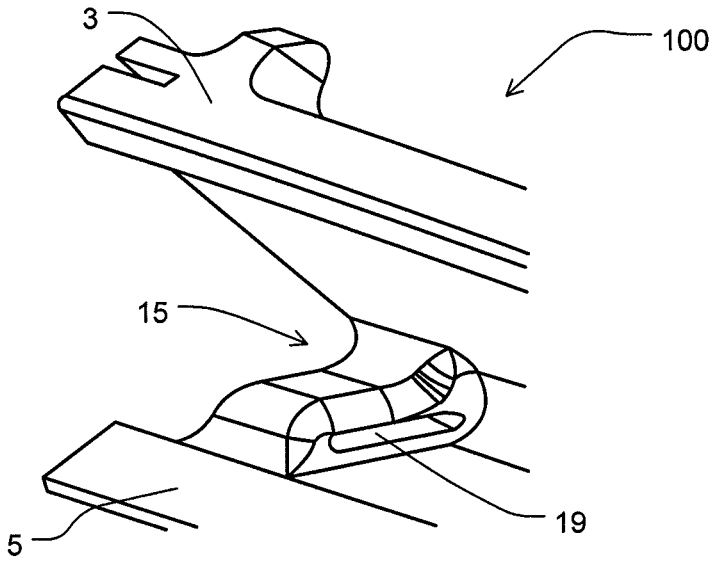
FIG. 4*b* is another perspective view of the further stator vane segment according to the present invention shown in FIG. 4*a*.

FIG. 4*b* shows another perspective view of the further inventive stator vane segment 100 of FIG. 4*a*.

LIST OF REFERENCE NUMERALS

| Reference Numeral | Description |
|---|---|
| 100 | stator vane segment |
| 200 | stator vane |
| x | direction of flow, axial direction |
| y | radial direction |
| z | circumferential direction |
| 1 | upstream, forward casing-side attachment means |
| 3 | downstream, rearward casing-side attachment means |
| 5 | platform |
| 7 | pressure side of the stator vane |
| 9 | suction side of the stator vane |
| 11 | stator vane leading edge |
| 13 | stator vane trailing edge |
| 15 | connection region that connects the rearward attachment means to the platform |
| 17 | first sealing section |
| 17a, 17b | second/third sealing sections |
| 18 | section of the platform downstream of the connection region |
| 19 | first slot |
| 20 | second slot |

-continued

| Reference Numeral | Description |
|---|---|
| 21 | wall thickness in the radial direction without sealing section |
| 23 | wall thickness in the radial direction with sealing section |
| 24 | Third Slot |

What is claimed is:

1. A stator vane segment of a fluid flow machine, the stator vane segment comprising:

a downstream casing-side attachment; and a platform, the downstream attachment being provided on the platform, the platform having a first sealing section and extending in the direction of flow beyond a connection region connecting the downstream attachment to the platform, the first sealing section located in a section downstream of the connection region having a first slot, the first slot being continuous in the circumferential direction and forming a passage through said section in the circumferential direction.

2. The stator vane segment as recited in claim 1 further comprising an upstream casing-side attachment provided on the platform.

3. The stator vane segment as recited in claim 2 wherein the upstream attachment has a second sealing section, and the downstream attachment has a third sealing section.

4. The stator vane segment as recited in claim 3 wherein at least one of the first, second and third sealing section is adapted for insertion of sealing plates or have sealing plates.

5. The stator vane segment as recited in claim 1 wherein the first sealing section is adapted for insertion of sealing plates or have sealing plates.

6. The stator vane segment as recited in claim 1 wherein the platform and the first sealing section extend beyond an airfoil trailing edge of a stator vane in the direction of flow downstream of the connection region.

7. The stator vane segment as recited in claim 1 wherein the section of the platform downstream of the connection region has a second slot radially continuous outwardly and/or inwardly.

8. The stator vane segment as recited in claim 1 wherein the section of the platform downstream of the connection region has a third slot continuous in the circumferential direction.

9. The stator vane segment as recited in claim 1 wherein the section of the platform downstream of the connection region has a tapered wall thickness in a portion thereof.

10. The stator vane segment as recited in claim 1 wherein the stator vane segment has at least two stator vanes.

11. The stator vane segment as recited in claim 1 wherein the stator vane segment is manufactured as a casting.

12. A turbine comprising at least one stator vane segment as recited in claim 1.

* * * * *